US007004898B2

(12) United States Patent
Hara

(10) Patent No.: US 7,004,898 B2
(45) Date of Patent: Feb. 28, 2006

(54) ROTOR FOR A CENTRIFUGAL SEPARATOR

(75) Inventor: Minoru Hara, Gunma (JP)

(73) Assignee: Kabushiki Kaisha Kubota Seisakusho, Toshima-Ku (JP)

( * ) Notice: Subject to any disclaimer, the term of this patent is extended or adjusted under 35 U.S.C. 154(b) by 218 days.

(21) Appl. No.: 10/620,889

(22) Filed: Jul. 16, 2003

(65) Prior Publication Data

US 2005/0101467 A1 May 12, 2005

(30) Foreign Application Priority Data

Jul. 17, 2002 (JP) ..... 2002-207987

(51) Int. Cl.
*B04B 5/02* (2006.01)

(52) U.S. Cl. ..... 494/16

(58) Field of Classification Search ..... 494/16, 494/20, 21, 31, 33, 85
See application file for complete search history.

(56) References Cited

U.S. PATENT DOCUMENTS

| | | | | |
|---|---|---|---|---|
| 3,133,882 | A | | 5/1964 | Mitchell et al. |
| 3,366,320 | A | * | 1/1968 | Cho |
| 3,998,383 | A | | 12/1976 | Romanauskas et al. |
| 4,076,170 | A | | 2/1978 | Chulay et al. |
| 4,301,963 | A | | 11/1981 | Nielsen |
| 4,304,356 | A | | 12/1981 | Chulay et al. |
| 4,412,830 | A | | 11/1983 | Strain et al. |
| 4,832,678 | A | | 5/1989 | Sheeran |
| 5,310,527 | A | * | 5/1994 | Romanauskas et al. |
| 5,354,254 | A | | 10/1994 | Zabriskie et al. |
| 5,382,220 | A | * | 1/1995 | Romanauskas et al. |
| 5,728,038 | A | * | 3/1998 | Coffey et al. |
| 5,935,052 | A | * | 8/1999 | Hall et al. |
| 6,083,462 | A | * | 7/2000 | Ikonen et al. |
| 2003/0203800 | A1 | | 10/2003 | Aizawa et al. |
| 2004/0209755 | A1 | * | 10/2004 | Moore et al. |

FOREIGN PATENT DOCUMENTS

| | | | |
|---|---|---|---|
| EP | 0626206 | | 11/1994 |
| EP | 1384512 | * | 1/2005 |
| JP | 58-6257 | * | 1/1983 |
| JP | 61-200868 | * | 9/1986 |
| JP | 1-293151 | * | 11/1989 |
| JP | 05-15955 U | | 4/1993 |
| JP | 8-309232 | * | 11/1996 |

* cited by examiner

*Primary Examiner*—Charles E. Cooley
(74) *Attorney, Agent, or Firm*—Blakely Sokoloff Taylor & Zafman

(57) ABSTRACT

A centrifugal separator includes a rotor. In the rotor, contact portions each for coming into contact with an outer surface of the cap of a sample tube are formed in open end sides of storing holes. The contact portions respectively have notches at portions thereof which face an axis. An adapter for a centrifugal separator is also disclosed.

3 Claims, 6 Drawing Sheets

ROTOR FOR A CENTRIFUGAL SEPARATOR

BACKGROUND OF THE INVENTION

The present invention relates to a rotor and adapter for a centrifugal separator which centrifuges a sample in a sample tube by rotatably driving a rotor loaded with the sample tube.

In a centrifugal separator of this type, a sample tube containing a sample to be centrifuged is loaded in a rotor attached to a centrifugal machine. The rotor is rotated for a necessary period of time with a rotational speed (centrifugal force) necessary for separating the sample, so that the sample is centrifuged. The sample tube (e.g., a centrifuge tube) for receiving the sample to be subjected to centrifugal action is placed under a high centrifugal force, and accordingly the liquid sample contained in the sample tube generates an internal pressure. To prevent the sample tube from bursting by the internal pressure, the sample tube is made of a material that can withstand a high centrifugal force. In general, for centrifugal action with a centrifugal force of 10,000 xg or more, a material that can withstand a high centrifugal force is used. This leads to a high cost.

In order to solve this problem, in recent years, a tissue culture tube (to be merely referred to as a conical tube hereinafter) made of, e.g., a plastic is used as an inexpensive sample tube. As this conical tube is a container originally developed for tissue culture, it has undergone sterilization which is necessary for biological operation. Accordingly, when the conical tube is to be used as a sample tube for centrifugal action, additional sterilization can be omitted. In view of this fact, conical tubes have been conveniently used as sample tubes for centrifugal action.

When centrifugal action is to be performed with the conical tube, the conical tube must be prevented from bursting by the internal pressure of the liquid sample in it which is generated by the centrifugal force. For this purpose, a high dimensional precision that allows substantially no gap between the conical tube and the storing hole of the rotor is required. For example, Japanese Utility Model Publication No. 5-15955 discloses a bucket for a centrifugal separator for a conical tube. The bucket disclosed in this reference is a bucket mainly for low-speed centrifugal action.

As a rotor for high-speed centrifugal action, one as shown in FIG. 7 is available. Referring to FIG. 7, a rotor 2A for a centrifugal separator which rotates at a high speed has a mortar-like recess 2*a* in its upper surface. A plurality of (four) blind storing holes 3 are formed in the outer peripheral portion of the upper surface of the rotor 2A at substantially equiangular intervals in the circumferential direction such that their upper portions are inwardly inclined at required angles with respect to an axis X of the rotor 2A. A sample tube (conical tube) 4 shown in FIG. 8 is to be inserted in each storing hole 3. The sample tube 4 is formed of a plastic tube 5 having a bottomed and slightly tapered substantially cylindrical shape with a conical bottom, and a screw cap (to be merely referred to as a cap hereinafter) 6 serving as a lid for closing the upper end opening of the tube 5. A liquid sample 7 is poured into the tube 5.

In the tube 5, a diameter D1 at the upper end is slightly larger than a diameter D2 at the lower end, so the diameter gradually, slightly decreases from the upper end toward the lower end. A diameter D3 of the cap 6 is larger than the diameter D1 of the tube 5 at the upper end. The tube 5 is formed with a high dimensional precision that allows substantially no gap between the inner wall of the storing hole 3 of the rotor 2A described above and the sample tube 4 stored in the storing hole 3. More specifically, the storing hole 3 is also formed such that its diameter at its open end is larger than its diameter at its deep end, so that the sample tube 4 can be stored in the storing hole 3 with no gap. A depth L2 of the storing hole 3 is smaller than a total length L1 of the tube 5 of the sample tube 4, so that the upper end of the sample tube 4 stored in the storing hole 3 and the cap 6 project from the storing hole 3.

A driving shaft 9 is rotated by a motor (not shown). A hub 10 is fitted on the upper end of the driving shaft 9. A center hole 11 is formed to extend through the center of the rotor 2A. When the hub 10 is engaged in the center hole 11 and a set screw 12 is screwed into a screw hole formed in the hub 10, the rotor 2A is fixed to the hub 10. The hub 10 has a plurality of drive pins 13 for transmitting the rotation of the driving shaft 9 to the rotor 2A.

In this arrangement, when centrifugal action is to be performed, the sample tube 4 containing the liquid sample 7 is inserted in the storing hole 3 of the rotor 2A. When a motor (not shown) is driven, the driving shaft 9 rotates, and this rotation is transmitted to the rotor 2A through the hub 10. Hence, the rotor 2A rotates at a high speed to apply a centrifugal force to the liquid sample 7 in the sample tube 4. Thus, a sample with a high density is moved outward in the radial direction of the rotor 2A, and a sample with a low density is moved inward in the radial direction of the rotor 2A, thus separating the liquid sample 7.

It is confirmed that when the rotor 2A is rotated at 11,000 rpm (about 10,000 xg) to 12,000 rpm (about 14,000 xg) by using a centrifugal separator 1A for a high speed process having this arrangement, the sample tube 4 does not burst.

FIGS. 9, 10A, and 10B show a conventional case wherein a sample tube 4A has a small diameter. In this case, the small-diameter sample tube 4A is stored in the storing hole 3 of the rotor 2A through an adapter 41, and centrifugal action is performed. As shown in FIG. 10A, a diameter D4 of a tube 5 of the sample tube 4A is smaller than the diameter D2 of the tube 5 of the sample tube 4 shown in FIG. 7 described above. When the small-diameter sample tube 4A is stored in the storing hole 3 of the rotor 2A, as the inner diameter of the storing hole 3 and the outer diameter of the tube 5 of the sample tube 4A are different, if centrifugal action is performed, the tube 5 may burst. To prevent this, the sample tube 4A is stored in the storing hole 3 through the adapter 41 as shown in FIG. 10B.

More specifically, the adapter 41 has a bottomed cylindrical shape, and has a tube holding hole 44 for holding the tube 5A of the sample tube 4A. A depth L3 of the tube holding hole 44 is slightly smaller than a total length L4 of the tube 5A of the sample tube 4A. Therefore, when the tube 5A of the sample tube 4A is inserted in the tube holding hole 44 of the adapter 41, the tube 5A fits in the tube holding hole 44 with substantially no gap, and the cap 6A of the sample tube 4A projects from the tube holding hole 44 of the adapter 41, as shown in FIG. 9. A total length L5 of the adapter 41 is larger than the depth L2 of the storing hole 3 of the rotor 2A. When the adapter 41 is inserted in the storing hole 3, its upper end projects from the storing hole 3, as shown in FIG. 9.

In the states as shown in FIGS. 7 and 9, the liquid samples 7 in the sample tubes 4, 4A are centrifuged by rotating the rotor 2A at 11,000 rpm (about 10,000 xg) to 12,000 rpm (about 14,000 xg). When centrifugal action is ended, the operator holds caps 6, 6A of the sample tubes 4, 4A and extracts the sample tubes 4, 4A from the storing holes 3 of the rotors 2A respectively.

In recent years, due to the development in genetic analysis and the like, demand has arisen for further increasing the speed of the rotors 2A so that the rotors 2A can be rotated at near 15,000 rpm (about 22,000 xg). Under such higher centrifugal force, the entire side walls of the tubes 5, 5A of the sample tubes 4, 4A which try to expand by the internal pressure generated by the centrifugal force applied to the liquid samples 7 are supported by the inner walls of the storing holes 3 of the rotors 2A, so that it can be prevented from bursting.

Even if a play is formed between the tubes 5, 5A and the storing holes 3, when water is poured between them, a centrifugal force acts on the poured water, and a water pressure is generated. The water pressure acts as a pressure against the internal pressure generated by the liquid samples 7 in the tubes 5, 5A. Hence, bursting of the tubes 5, 5A can be prevented.

When, however, extracting the sample tubes 4, 4A from the storing holes 3, the operator must hold the caps 6, 6A with his or her fingers. For this purpose, the caps 6, 6A project from the storing hole 3 or adapter 41. Accordingly, due to the centrifugal force acting on the caps 6, 6A, the caps 6, 6A may deform as indicated by an alternate long and two short dashed line in FIG. 7, and its neck may be flattened and, in a worst case, may be torn, be broken, and scatter.

SUMMARY OF THE INVENTION

The present invention has been made in view of the conventional problems described above, and has as its object to provide a rotor for a centrifugal separator, which prevents deformation and breaking of a sample tube under a high centrifugal force, so that a particularly inexpensive sample tube can be used.

It is another object of the present invention to provide an adapter for a centrifugal separator, which prevents deformation and bursting of a sample tube under a high centrifugal force when the sample tube has a smaller diameter than that of the storing hole of a rotor for the centrifugal separator, so that a particularly inexpensive sample tube can be used.

In order to achieve the above objects, according to an aspect of the present invention, there is provided, in a centrifugal separator comprising a rotor in which storing holes each for storing a sample tube with a cap are formed to be inclined with respect to an axis such that an open end of each of the storing holes is directed toward the axis, a rotor for the centrifugal separator, wherein contact portions each coming into contact with an outer surface of the cap of the sample tube are formed in open end sides of the storing holes, and the contact portions respectively have notches at portions thereof which face the axis.

DESCRIPTION OF THE PREFERRED EMBODIMENTS

The embodiments of the present invention will be described with reference to the accompanying drawings.

Figure 1:
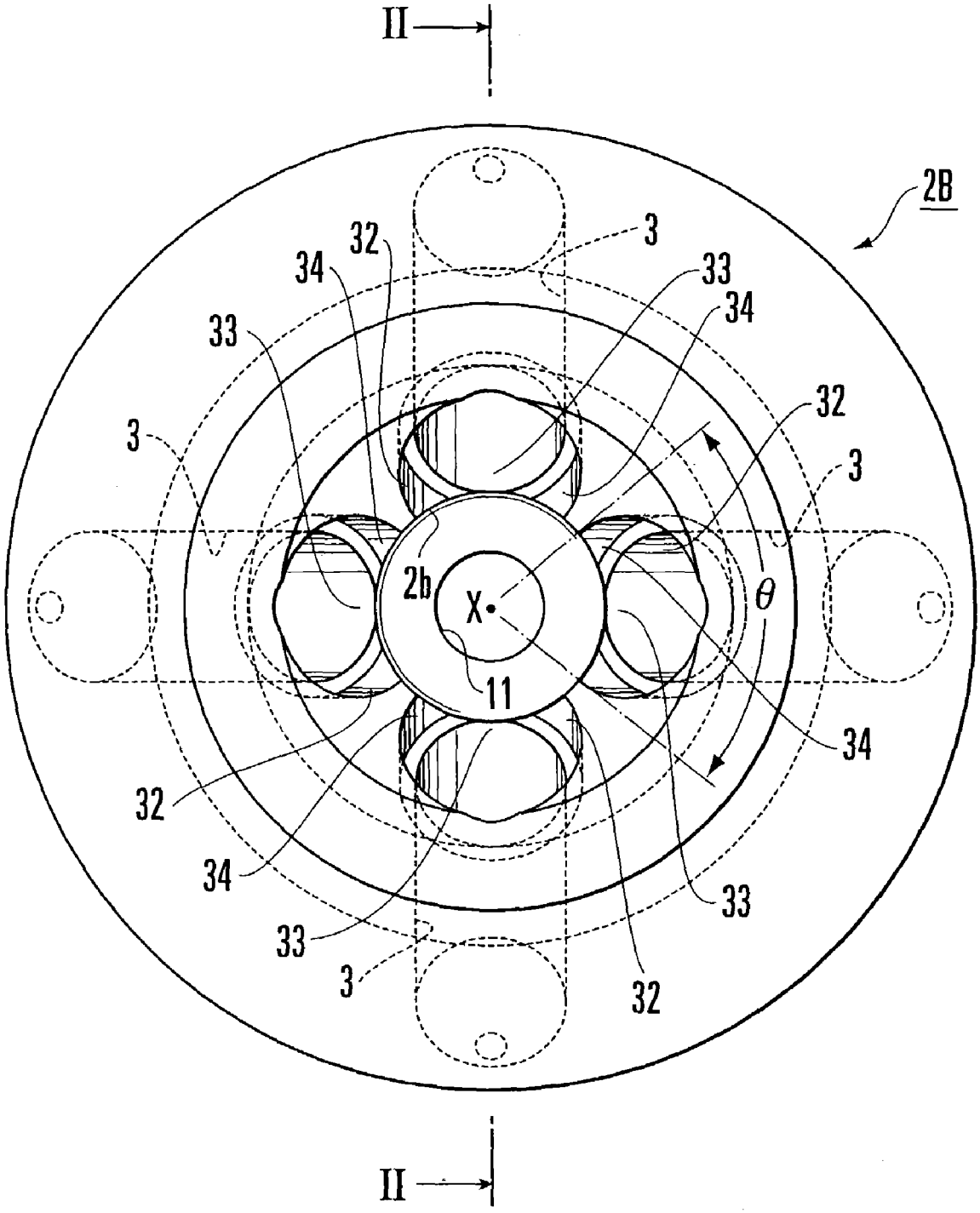
FIG. 1 is a plan view of the main part of a centrifugal separator according to the present invention.
Figure 2:
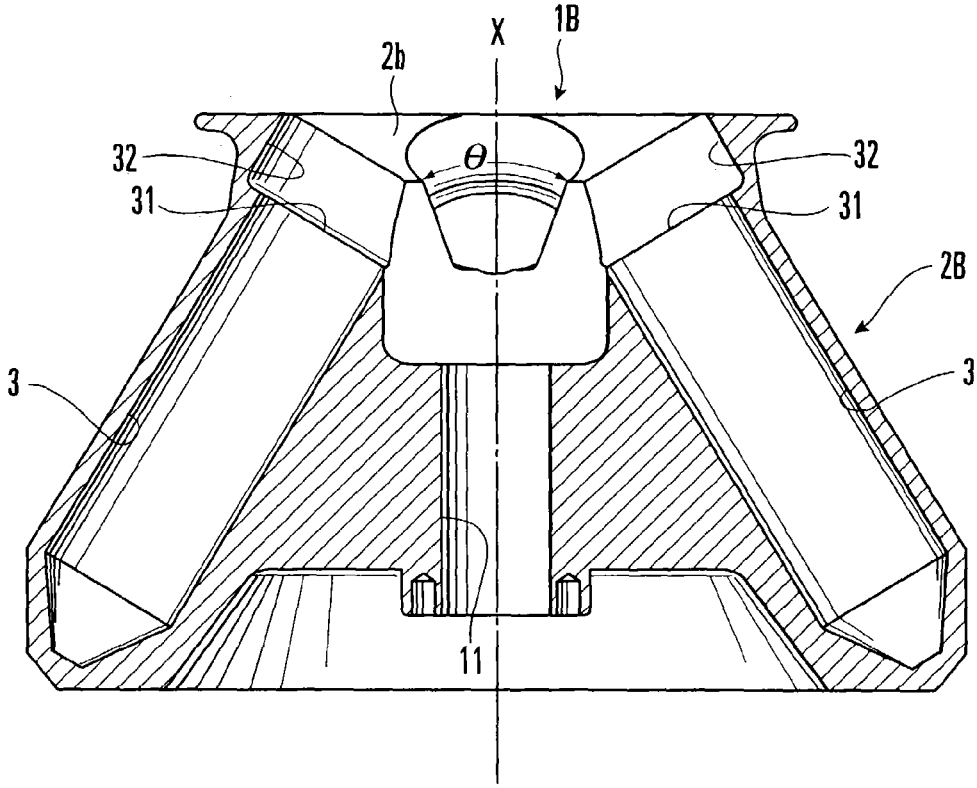
FIG. 2 is a sectional view taken along the line II—II of FIG. 1.
Figure 3:
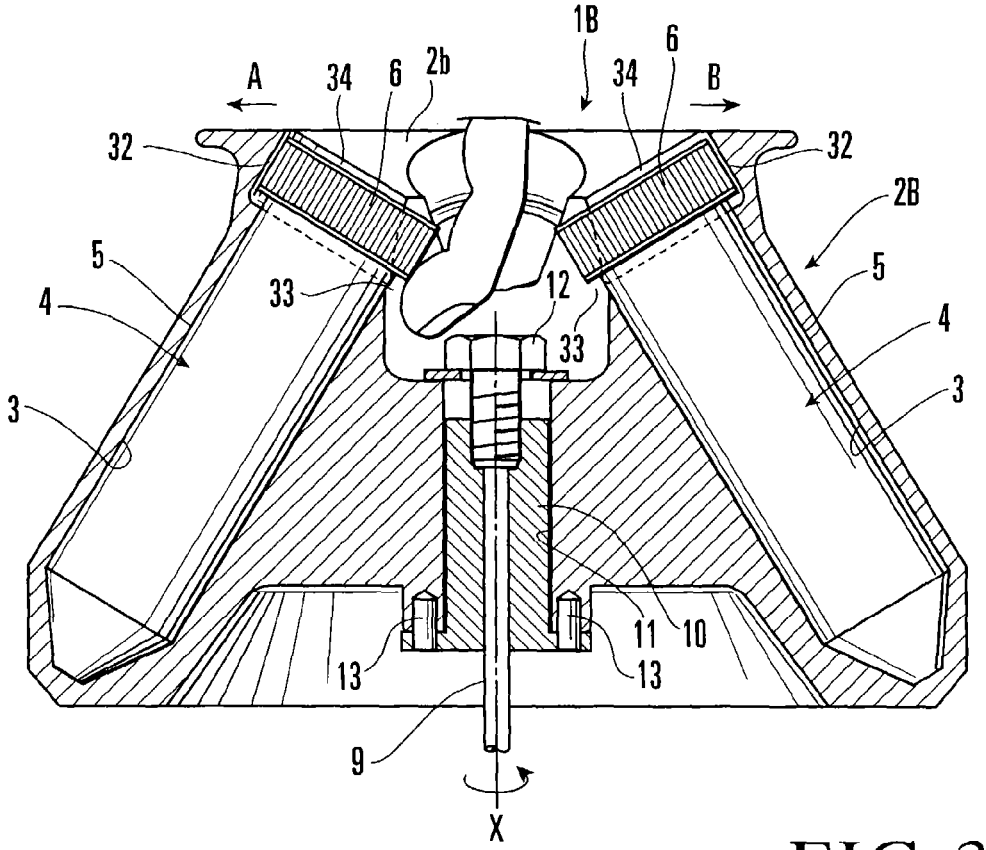
FIG. 3 is a sectional view showing a state wherein sample tubes are loaded in a rotor in the centrifugal separator according to the present invention.
Figure 7:
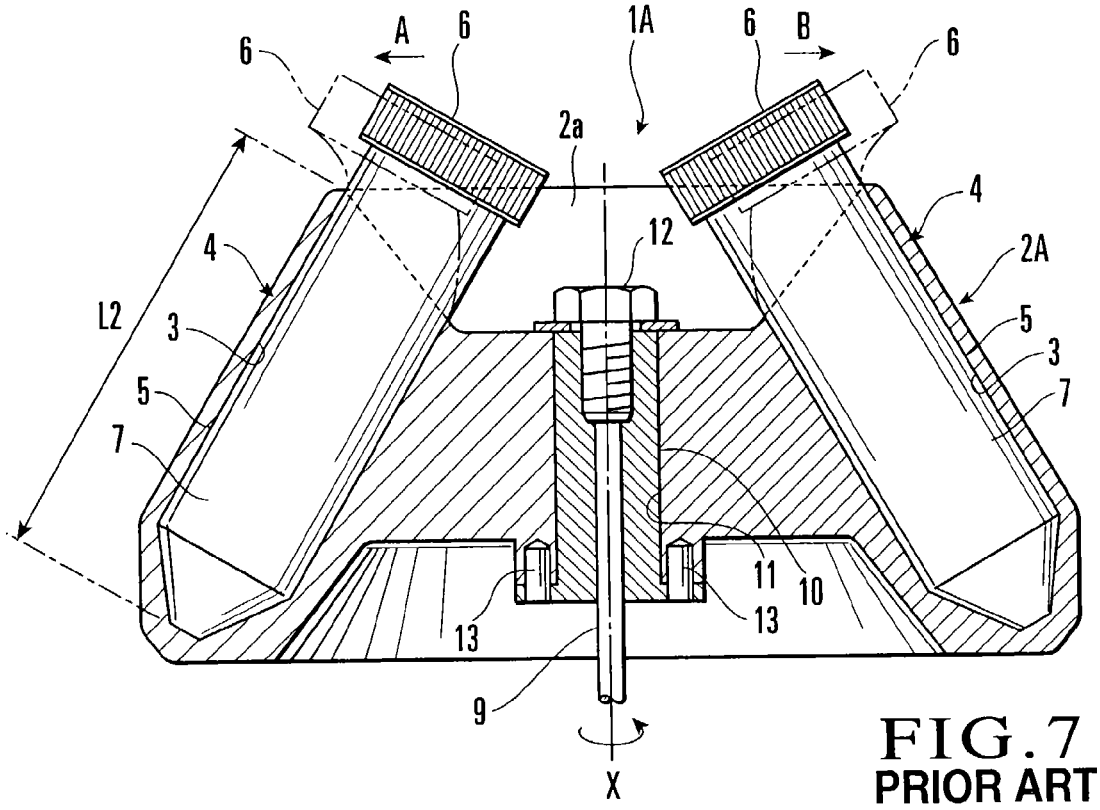
FIG.7 PRIOR ART
FIG. 7 is a sectional view showing the main part of a conventional centrifugal separator.
Figure 8:
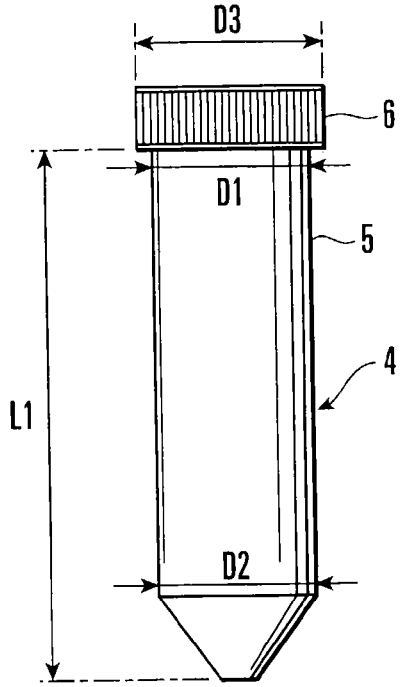
FIG. 8 PRIOR ART
FIG. 8 is a front view showing the outer appearance of a general sample tube.

FIG. 1 is a plan view of the main part of a centrifugal separator according to the present invention, FIG. 2 is a sectional view taken along the line II—II of FIG. 1, and FIG. 3 is a sectional view showing a state wherein sample tubes are loaded in a rotor of the centrifugal separator. Referring to FIGS. 1 to 3, members that are the same or identical to those described in the prior art shown in FIGS. 7 and 8 described above are denoted by the same reference numerals, and a detailed description thereof will be omitted when necessary.

The centrifugal separator shown in FIGS. 1 to 3 has a rotor 2B having storing holes 3 for storing sample tubes 4 with caps 6. The storing holes 3 are inclined with respect to an axis X. Open ends 31 of the storing holes 3 are directed toward the axis X. Each storing hole 3 has a contact portion 32, on its open end 31 side, to come into contact with the outer surface of the cap 6 of the sample tube 4. The contact portion 32 has a notch 33 at its portion facing the axis X.

This will be described in more detail. The rotor 2B of a centrifugal separator 1B of this embodiment is characterized in the following respects. The four storing holes 3 are arranged at equiangular intervals in the circumferential direction. Each cap contact portion 32 is formed with a substantially ring-like shape to surround the cap 6 attached to the opening of the sample tube 4 to project upward from the open end 31 of the corresponding storing hole 3, i.e., from the upper end of the storing hole 3. The diameter of a cap storing portion 34 surrounded by the cap contact portion 32 and having a substantially cylindrical shape is slightly larger than a diameter D3 of the cap 6 of the sample tube 4, and the height of the cap storing portion 34 is slightly larger than that of the cap 6. Accordingly, as will be described later, when the sample tube 4 is stored in the storing hole 3, the cap 6 of the sample tube 4 is entirely stored in the cap storing portion 34, so that the outer surface of the cap 6 opposes the inner wall of the cap contact portion 32 at a small gap. Note that the height of the storing portion 34 suffices as far as it can prevent deformation of the cap 6 in the lateral direction. If the height of the cap storing portion 34 is slightly smaller than that of the cap 6, it poses no problem.

The notch 33 extending in the direction of the axis X of the rotor 2B is formed in part of each contact portion 32. The notch 33 is located toward the axis (rotation center) of the rotor 2B, i.e., on a center hole 11 side, and opposes a recess 2*b* cylindrically formed in the center of the upper portion of the rotor 2B. Thus, as shown in FIG. 1, the cap storing portions 34 are formed on the opposite sides with respect to the axis (rotation center) of the rotor 2B when seen in a plan view, and have fan-like shapes each extending within the range of an angle θ in the circumferential direction where θ>180°. Because of the notch 33, when the sample tube 4 is stored in the storing hole 3, part of the outer surface of the cap 6 exposes through the notch 33, as will be described later.

With this arrangement, as shown in FIG. 3, when the sample tube 4 is stored in the storing hole 3 of the rotor 2B, the cap 6 is stored in the cap storing portion 34 such that the outer surface of the cap 6 of the sample tube 4 opposes the inner wall of the cap contact portion 32 at a small gap. In this state, when the rotor 2B is rotated at a high speed to centrifuge the sample in the sample tube 4, a centrifugal force in a direction of an arrow A or B, i.e., in a direction opposite to the direction toward the rotation center of the rotor 2B, acts on the cap 6. The cap contact portions 32 are formed on the opposite sides with respect to the axis X (rotation center) of the rotor 2B when seen in a plan view, and have fan-like shapes each extending within the range of the angle θ in the circumferential direction where θ>180°. Accordingly, the outer surface of the cap 6 opposes the cap contact portion 32 except for the rotation center side of the rotor 2B. Even if a centrifugal force acts on the cap 6, the cap 6 comes into contact with the cap contact portion 32, and its deformation is regulated by the cap contact portion 32. Thus, the cap 6 will not deform in the direction of the arrow A or B, i.e., toward the cap contact portion 32.

When all the cap contact portions 32 corresponding to the storing holes 3 are integrally formed, the strengths of the contact portions are further increased, so that the contact portions can sufficiently withstand a high centrifugal force.

In this manner, even when the sample tube 4 is not made of a material that can withstand a high centrifugal force, its deformation can be regulated even under a high centrifugal force. Therefore, high-speed centrifugal action is enabled by using an inexpensive sample tube 4.

When centrifugal action is ended, as shown in FIG. 3, the operator puts his or her finger in the notch 33 of the contact portion 32 through the recess 2*b* of the rotor 2B, and places his finger on the cap 6, to extract the sample tube 4 from the storing hole 3. In this manner, as the cap contact portion 32 has the notch 33 which partly exposes the cap 6, the sample tube 4 can be easily extracted from the storing hole 3 of the rotor 2B.

Figure 4:
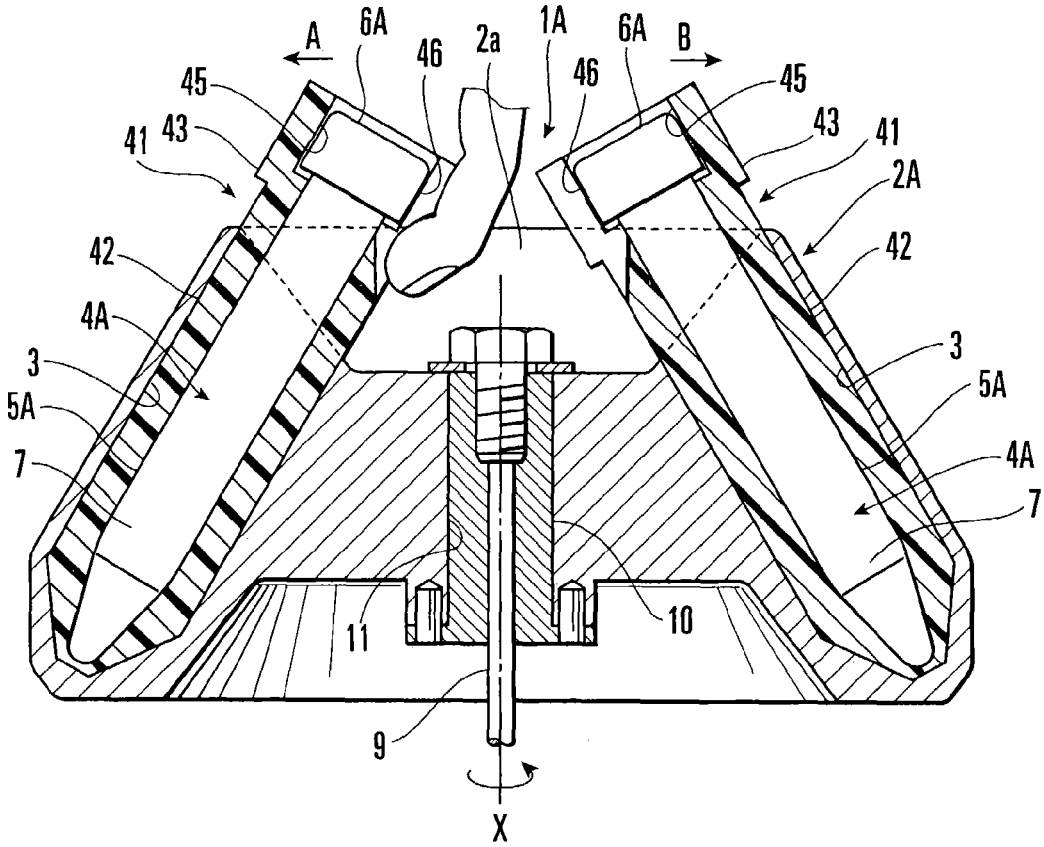
FIG. 4 is a sectional view showing the second embodiment of the present invention in a state wherein sample tubes are loaded in a rotor.
Figure 5A:
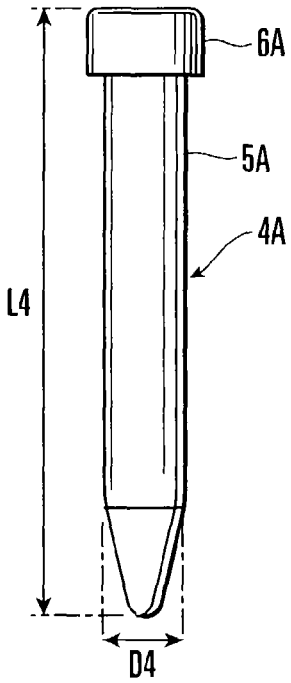
FIG. 5A is a front view showing the outer appearance of a sample tube in the second embodiment of the present invention.
Figure 5B:
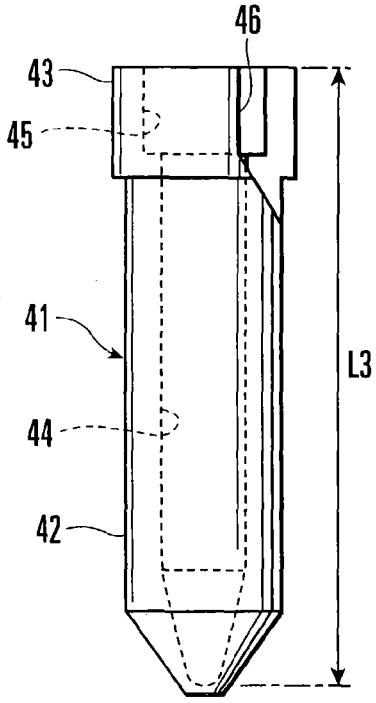
FIG. 5B is a front view showing the outer appearance of an adapter.

FIGS. 4, 5A, and 5B show the second embodiment of the present invention, in which FIG. 4 is a sectional view showing a state wherein sample tubes are loaded in a rotor, FIG. 5A is a front view showing the outer appearance of a sample tube, and FIG. 5B is a front view showing the outer appearance of an adapter. Referring to FIGS. 4, 5A, and 5B, members that are the same or identical to those described in the prior art shown in FIG. 9 and FIGS. 10A and 10B described above are denoted by the same reference numerals, and a detailed description thereof will accordingly be omitted when necessary.

The second embodiment is characterized in the following respects. In a centrifugal separator having a rotor 2B in which storing holes 3 for storing sample tubes 4A with caps 6A are inclined with respect to an axis X such that open ends 31 of the storing holes 3 are directed toward the axis X, an adapter is provided. The adapter has a holding hole 44 for holding the sample tube 4A. A contact portion 43 for coming into contact with the outer surface of the cap 6A of the sample tube 4A is formed on the open end side of the tube holding hole 44. A notch 46 is formed in part of the contact portion (cap holding portion) 43.

More specifically, as shown in FIG. 5B, the characteristic feature of the second embodiment resides in that an adapter 41 integrally has the substantially cylindrical cap holding portion 43 in its plastic substantially bottomed cylindrical tube holding portion 43, and that the notch 46 vertically extending through the cap holding portion 43 is formed in part of the cap holding portion 43. The tube holding portion 42 has the tube holding hole 44 where the tube 5A of the sample tube 4A is to be fitted and held. The cap holding portion 43 has a cap holding hole 45 which communicates with the tube holding hole 44 and in which the cap 6A is to be fitted and held. Note that the adapter 41 has an outer shape enough to be stored in the storing hole 3.

A length L3 from the lower end of the cap holding hole 44 of the adapter 41 to the upper end of the cap holding hole 45 is slightly larger than a total length L4 of the sample tube 4A. Accordingly, when the tube 5A of the sample tube 4A is inserted in the tube holding hole 44 of the adapter 41, it fits in the tube holding hole 44 with substantially no gap.

Simultaneously, as shown in FIG. 4, the outer surface of the cap 6A opposes the inner wall of the cap holding hole 45 at a small gap such that the cap 6A of the sample tube 4A is entirely stored in the cap holding hole 45 of the adapter 41.

Figure 9:
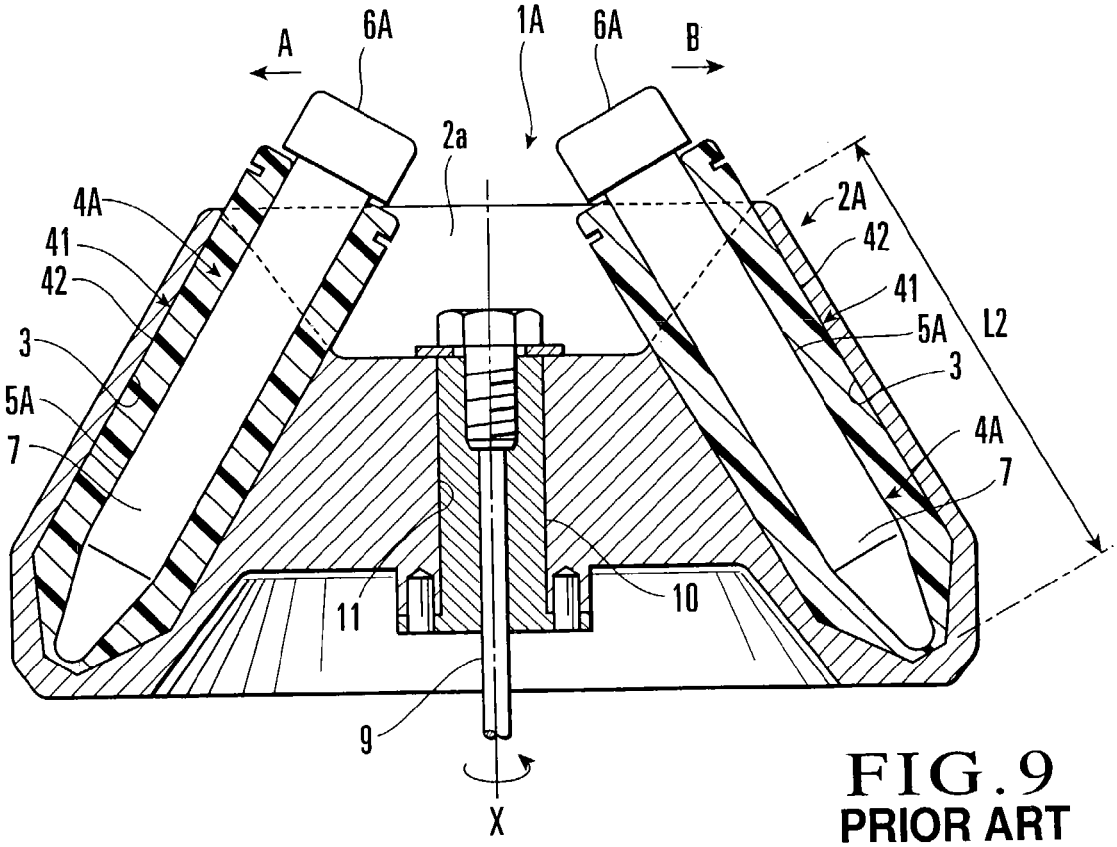
FIG. 9 PRIOR ART
FIG. 9 is a sectional view showing the main part of the second example of the conventional centrifugal separator.
Figure 10A:
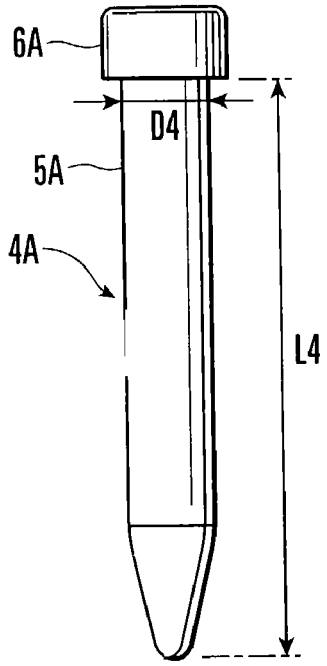
FIG. 10A PRIOR ART
FIG. 10A is a front view showing the outer appearance of a general small-diameter sample tube.
Figure 10B:
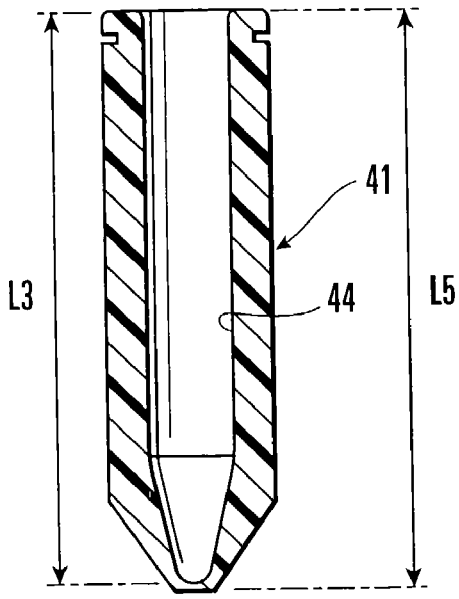
FIG. 10B PRIOR ART
FIG. 10B is a sectional view of a conventional adapter.

In this manner, the adapter 41 which holds the sample tube 4A is stored in the storing hole 3 of the conventional rotor 2A shown in FIG. 9 described above. More specifically, the adapter 41 is stored in the storing hole 3 of the rotor 2A such that the notch 46 of the cap holding portion 43 is directed toward the center hole 11 of the rotor 2A. Then, the adapter 41 fits in the storing hole 3 with substantially no gap, and the cap holding portion 43 of the adapter 41 and the upper end of the tube holding portion 42 project from the storing hole 3.

In this state, the rotor 2A is rotated at a high speed to centrifuge the sample in the sample tube 4A. As the tube 5A of the sample tube 4A is stored in the storing hole 3 through the tube holding portion 42 of the adapter 41, deformation by the internal pressure of the liquid sample 7 is prevented. Simultaneously, a centrifugal force in a direction of an arrow A or B in FIG. 4, i.e., in a direction opposite to a direction toward the axis (rotation center) X of the rotor 2A acts on the cap 6A. The outer surface of the cap 6A opposes the inner wall of the cap holding portion 43 of the adapter 41 at a small gap. Therefore, when the centrifugal force in the direction of the arrow A or B of the cap holding portion 43 is applied, the cap 6A comes into contact with the cap holding portion 43, so that deformation of the cap 6A in the direction of the arrow A or B can be regulated.

When centrifugal action is ended, as shown in FIG. 4, the operator puts his finger in the notch 46 of the adapter 41 through a recess 2*a* of the rotor 2A, and places his finger on the cap 6, to extract the sample tube 4A from the adapter 41.

Figure 6:
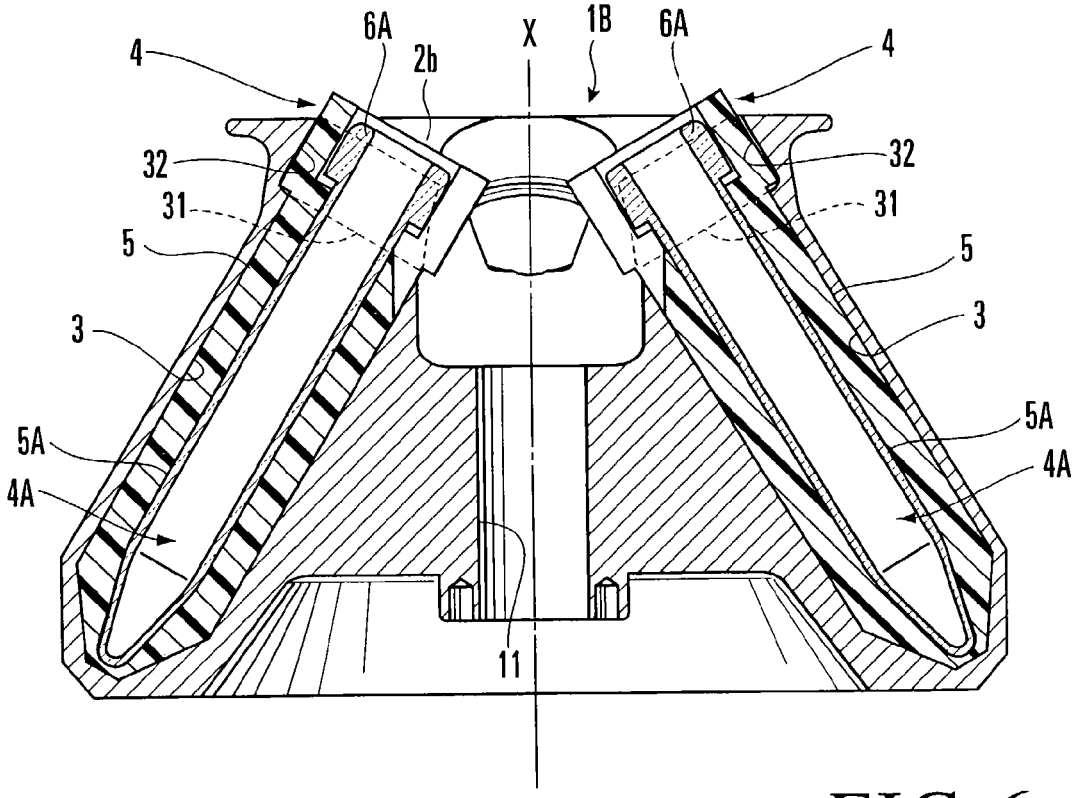
FIG. 6 is a view showing an embodiment as a combination of the first and second embodiments.

FIG. 6 shows an embodiment obtained by combining the first and second embodiments, and reference numerals used in the drawings of the first and second embodiments are employed in this embodiment unchanged.

According to this embodiment, when a sample tube smaller than the storing hole 3 of the rotor 2B for the centrifugal separator of FIG. 1 is to be used, an adapter 41 is inserted in the storing hole 3, and a sample tube 4A is stored in the adapter 41.

In this case, an outer portion 43*a* of a cap holding portion 43 of the adapter 41 is stored in a cap contact portion 32 formed in the rotor 2B. The cap holding portion 43 and the cap contact portion 32 have such dimensions that they oppose each other through a predetermined clearance.

In this embodiment, note that θ=240°. With this arrangement, deformation and breaking of an inexpensive sample tube are also prevented, so that high-speed centrifugal action can be performed. Extraction of the sample tube is also easy.

In the above embodiments, the diameter D3 of the cap 6 is larger than the diameter D1 of the tube 5 at the upper end. However, the diameter D3 and diameter D1 can be set equal to each other. It suffices as far as the diameter D3 is equal to or larger than the diameter D1. The diameter D1 of the tube 5 at the upper end is slightly larger than the diameter D2 of the tube 5 at the lower end. However, the diameter D1 and diameter D2 can be set equal to each other. It suffices as far as substantially no gap is formed between the tube 5 and the inner wall of the storing hole 3 when the sample tube 4 is stored in the storing hole 3 of the rotor 2B. Although the adapter 41 is made of a plastic material, it can be made of a metal. Various types of materials can be selectively used to form the adapter 41.

As has been described above, according to the present invention, not only high-speed centrifugal action using an inexpensive sample tube is enabled, but also the sample tube can be extracted from the storing hole easily.

What is claimed is:

1. An apparatus comprising:

a rotor for a centrifugal separator, the rotor having storing holes each for storing a sample tube with a cap that are formed to be inclined with respect to an axis such that an open end of each of the storing holes is directed toward the axis, wherein contact portions each coming into contact with an outer surface of the cap of the sample tube are formed in open end sides of the storing holes, and the contact portions respectively have notches at portions thereof which face the axis.

2. The apparatus according to claim 1, wherein the storing holes are arranged at equiangular intervals in a circumferential direction, and the contact portions corresponding to the respective storing holes are connected to each other.

3. The apparatus according to claim 1, wherein the rotor further comprises an adapter having a holding hole for holding a sample tube with a diameter smaller than that of the sample tube, a contact portion coming into contact with an outer surface of a cap of the sample tube is formed in an open end side of the holding hole, the contact portion has a notch at a portion thereof, and the adapter has an outer diameter which allows the adapter to be stored in the storing hole.

* * * * *